US005272756A

United States Patent [19]

Tanaka et al.

[11] Patent Number: 5,272,756

[45] Date of Patent: Dec. 21, 1993

[54] METHOD AND APPARATUS FOR DETERMINING PHASE CORRELATION OF A STEREOPHONIC SIGNAL

[75] Inventors: Naojiro Tanaka; Masakatu Mizukami, both of Kanagawa, Japan

[73] Assignee: Leader Electronics Corp., Yokohama, Japan

[21] Appl. No.: 779,514

[22] Filed: Oct. 18, 1991

[30] Foreign Application Priority Data

Oct. 19, 1990 [JP] Japan ..... 2-281221

[51] Int. Cl.[5] ..... H04H 5/00

[52] U.S. Cl. ..... 381/12; 381/1

[58] Field of Search ..... 381/1, 12

[56] References Cited

U.S. PATENT DOCUMENTS 4,236,041 11/1980 Thomas ..... 381/12
4,691,358 9/1987 Bradford .
4,782,530 11/1988 Torelli et al. ..... 381/1
4,908,868 3/1990 McTaggart ..... 381/12

FOREIGN PATENT DOCUMENTS 2439505 5/1980 France .
56-64600 6/1981 Japan .
63-3519 1/1988 Japan .

OTHER PUBLICATIONS

1987/88 Leader Electronic Measuring Catalog.
LPM-107A User's Manual, printed May 1988.
Sony/Tektronix Catalog, published Apr. 1986.
Sony/Tektronix publication entitled "Measurement for NTSC Television Systems" published Dec. 1987.
"Simple Reverse Phase Detector for Stereo Audio Signals", Fumio Takasuka and Tataumi Yoshida, 18th Meeting of Commerical Broadcasting Reports, pp. 9-10, (Oct. 21-23, 1981).
Tektronix 760 Stereo Audio Monitor Brochure.
Japanese Patent Abstract JP60235071 dated Nov. 21, 1985.
Japanese Patent Abstract JP56020344 dated Feb. 25, 1981.
European Search Report dated Feb. 12, 1993.
1989 Tektronix.

*Primary Examiner*—John K. Peng
*Assistant Examiner*—Edward Lefkowitz
*Attorney, Agent, or Firm*—Fish & Richardson

[57] ABSTRACT

A method and apparatus used for determining phasing correlation between left-channel and right-channel signals of a stereophonic audio signal is provided. The determination of the phase correlation is facilitated by deriving centrally localized components contained in the audio signal to provide an indication representative of phase correlation existing between the left-channel and right-channel signals.

17 Claims, 15 Drawing Sheets

| Fig. 8A |
| --- |
| Fig. 8B |

Fig. 11a
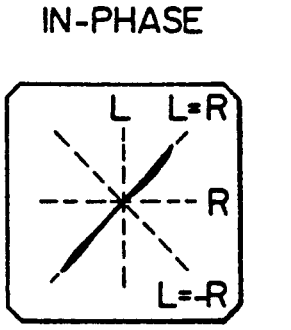
Fig. 11b
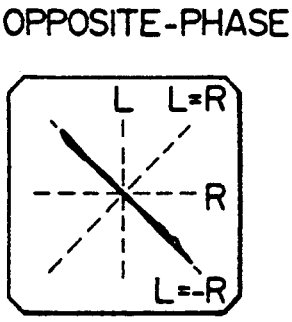
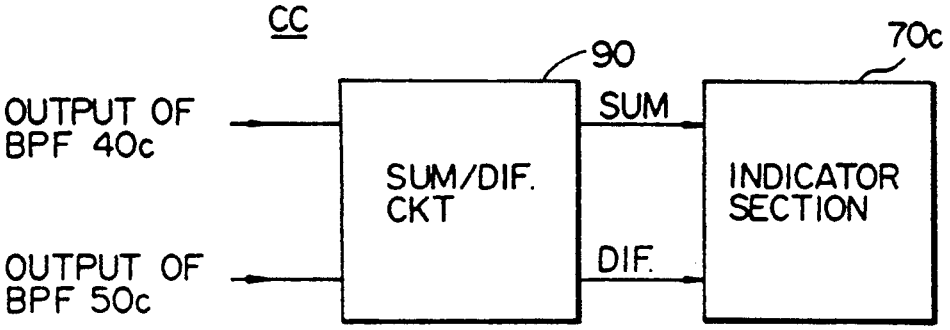
Fig. 12

METHOD AND APPARATUS FOR DETERMINING PHASE CORRELATION OF A STEREOPHONIC SIGNAL

BACKGROUND OF THE INVENTION

1. Field of the Invention

The present invention relates to a method and apparatus for determining phase correlation between the left (L) channel and right (R) channel signals of a stereophonic audio signal, and more particularly to a method and apparatus for determining an in-phase or opposite-phase correlation present in the channel signals.

2. Description of the Prior Art

Conventionally, in television or radio broadcasting stations or the like, in order to phase the L-channel and R-channel signals of a stereophonic audio signal (hereinafter referred to as R-ch and L-ch signals, respectively) with each other (such that at least signal components of the respective L-ch and R-ch signals which should be localized at the center of a sound field are in phase with each other and have the same amplitude), the phase correlation of the L-ch and R-ch signals is measured. Such a measurement is intended to ensure that stereophonic audio devices which are installed in a broadcasting station have their different sets of terminals (for example, hot (H), cold (C) and ground (G) terminals in a balanced transmission system) connected to each other with a particular polarity-terminal in a set of terminals being connected to a matching polarity-terminal in another set of terminals, as well as to determine the phase correlation, i.e. in-phase or opposite phase associated with a stereophonic audio signal in a produced program.

The measurement of such a phase correlation is often conducted using a stereo sound-image display device called a stereo audio monitor or a stereo monitor scope. FIG. 1 shows one such sound-image display device which comprises a sum and difference circuit and a cathode ray tube (CRT). The sum and difference circuit is connected to receive the L-ch and R-ch signals of a stereophonic signal and generates a sum signal (L+R) and a difference signal (R−L). The CRT is connected to receive the sum and difference signals at Y-axis and X-axis input terminals, respectively such that a Lissajous' figure for the stereophonic signal is displayed on the screen thereof.

In balanced type connectors, there are two different types, i.e. an American type and a European type wherein the assignment of polarities to terminals of a connector can be different between the two types. To determine if there is a matching polarity in the connection between any two of the connectors of audio devices, a sine wave of a single frequency is usually used as a test signal which is applied at one end of an audio system to the left and right channels such that Lissajous' figures at other different points in the system are displayed, thereby enabling the determination of the phase correlation of the L- and R-channels at each of the points. A vertical line (L=R) displayed as shown in FIG. 2*a* indicates that the L-ch signal and the R-ch signal appearing at a particular point are in phase with each other, and thus shows the possible presence of polarity matched connections in the portion up to that particular point. On the contrary, a horizontal line (L=−R) as shown in FIG. 2*b* indicates these signals in opposite phase, that is, the presence of erroneous connections. Alternatively, a phase meter may be used in place of the above-mentioned monitor for the determination of such polarity matched connections.

Then, the determination of the presence of an appropriate phase condition or phasing between L-ch and R-ch signals from an audio program is performed by applying the L-ch and R-ch signals, rather than the test signals, to the above-mentioned monitor to produce a sound image therefrom. Usually, an actual stereophonic signal, different from the test signal, has a variety of components to be differently localized in a sound field, and thus may present complex figures as shown in FIG. 2*c* or 2*d* on the screen regardless of whether the L-ch and R-ch signals of the stereophonic signal are in phase or in opposite phase.

As will be understood from FIGS. 2*c* and 2*d*, there is a higher possibility of erroneous determinations occurring in such a method of determining the phase correlation between L-ch and R-ch signals from a given stereo audio program on the basis of displayed sound images thereof, because when components other than centrally localized components, for example, background music, are prominent in the audio program, the sound image display of the audio program does not result in an image as shown in FIGS. 2*a* and 2*b*, thereby rendering the "in phase" or "in opposite phase" determination obscure.

In commercial television or radio broadcasting stations, a CM master tape is made for commercial messages to be aired during a particular day. Since several hundreds of CM tapes produced by CM production companies or the like must be rapidly edited to make a particular CM master tape for a day, the above-mentioned erroneous phase determinations may occur at an even higher rate.

An "in opposite phase" stereophonic CM program, if broadcast, will cause problems in sounds reproduced by receivers. More specifically, defective localization of sounds will occur in stereophonic receivers, while low level unclear sounds will be reproduced in monaural receivers.

In view of the problems mentioned above, an object of the present invention is to provide a method and apparatus which is used to more precisely determine the phase correlation for a given stereophonic audio signal which can include centrally localized components.

Another object of the present invention is to provide a method and apparatus which can be used for determining the phase correlation of stereophonic audio signals from a program such as a CM program.

SUMMARY OF THE INVENTION

To achieve the above objects, the present invention makes use of the fact that CM programs may often include narration, that is, a person's voice as centrally localized components of a stereophonic signal.

More specifically, in accordance with the present invention, there is provided an apparatus for determining phase correlation of a left channel signal and a right channel signal constituting a stereophonic audio signal which comprises: a first input terminal for receiving a left-channel signal of a given stereophonic audio signal and a second input terminal for receiving a right-channel signal of the audio signal; first extracting means coupled to receive a first signal from the first input terminal for extracting from the first signal components having frequencies within a selected range of frequencies to generate a third signal, the selected frequency range being extended to include at least a part of centrally localized components possibly contained in the given stereophonic audio signal; second extracting means coupled to receive a second signal from the second input terminal for extracting from the second signal components having frequencies within the selected frequency range to generate a fourth signal; and indication means coupled to receive the third and fourth signals for providing an indication representative of a phase correlation between the left-channel and right-channel signals of the given stereophonic audio signal based on the third and fourth signals.

Further, in accordance with the present invention, a method of determining a phase correlation between a left channel signal and a right channel signal constituting a stereophonic audio signal is provided which comprises the steps of: receiving a left-channel signal and a right-channel signal from a given stereophonic audio program containing centrally localized components within a predetermined frequency band and generating a first signal and a-second signal from said left-channel and right-channel signals; extracting at least components having frequencies falling within a selected range of frequencies included in said predetermined frequency band from said first signal and said second signal to derive a third signal and a fourth signal, respectively; and generating a fifth signal and a sixth signal from said third and fourth signal, and providing an indication representative of a phase correlation between said left-channel and right-channel signals of said given stereophonic audio program on the basis of said fifth and sixth signal.

The determination method and apparatus of the present invention, arranged as described above, functions to extract only centrally localized components, as far as possible, contained in each of the left and right channel signals of a stereophonic audio signal in order to provide an indication of the phase correlation between the left and right channel signals using the extracted components.

BRIEF DESCRIPTION OF THE DRAWINGS

The above and other objects, features and advantages of the present invention will become more apparent from the following detailed description given with reference to the accompanying drawings, which specify and show preferred embodiments of the present invention.

Figure 1:
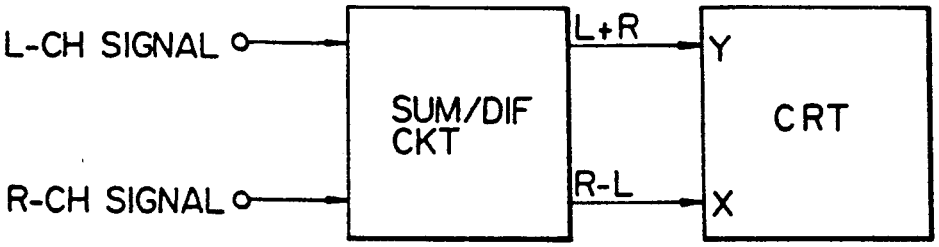
Fig. 1 (PRIOR ART)
FIG. 1 is a block diagram showing a conventional stereo audio scope.
Figure 3:
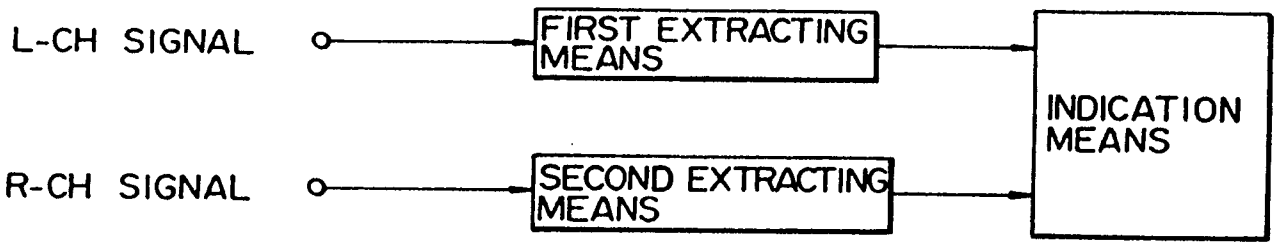
Figure 4A:
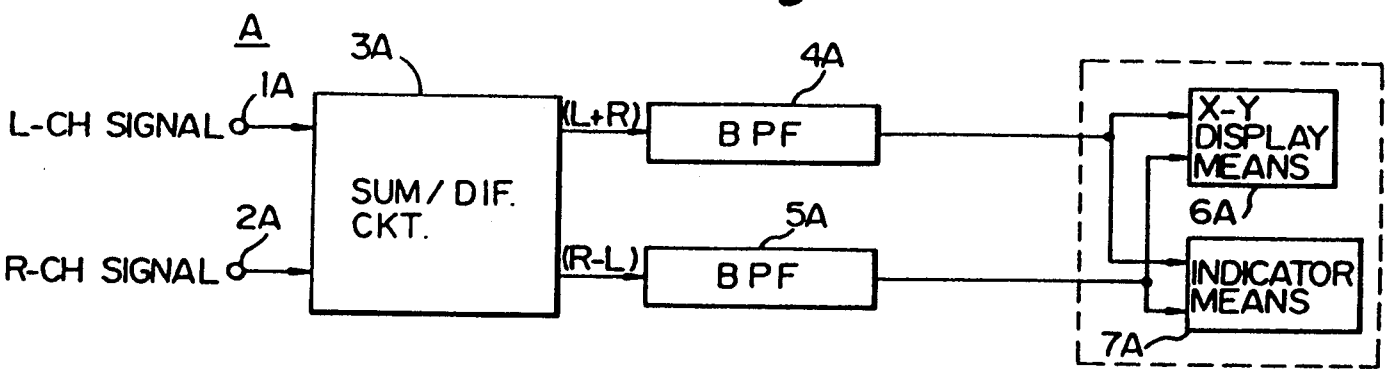
Figure 4B:
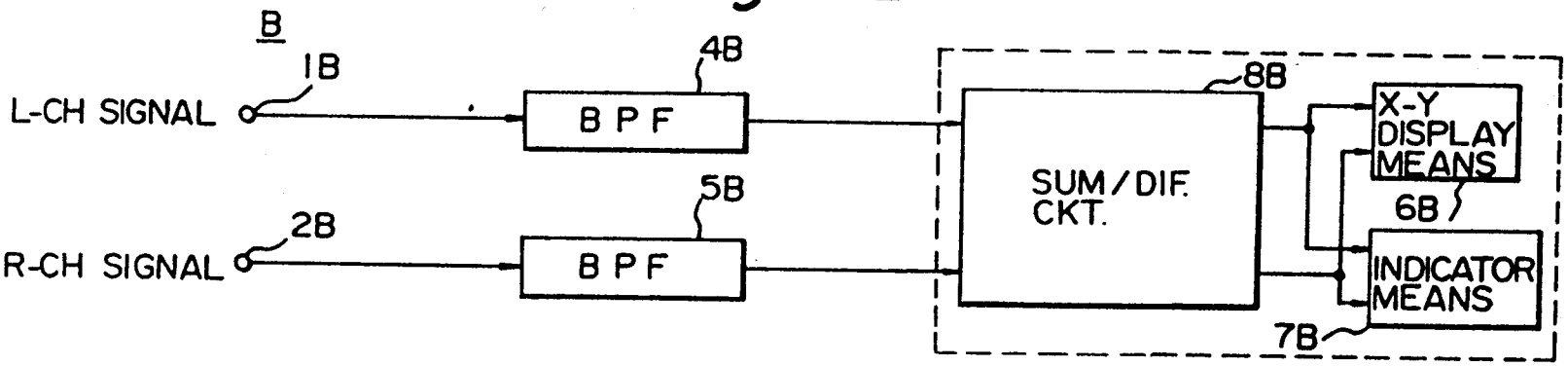
Figure 4C:
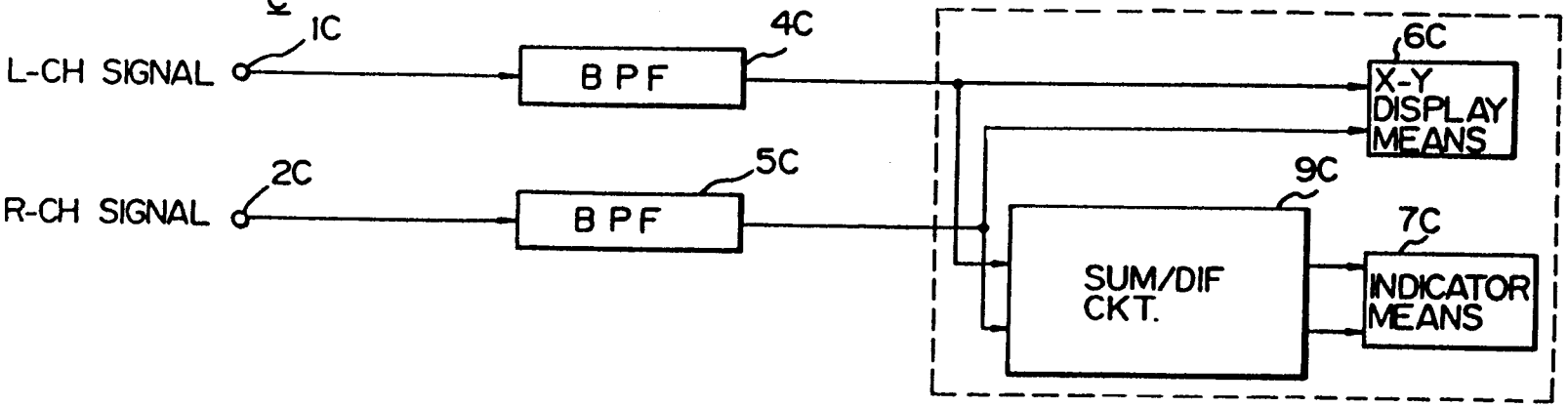
Figure 5:
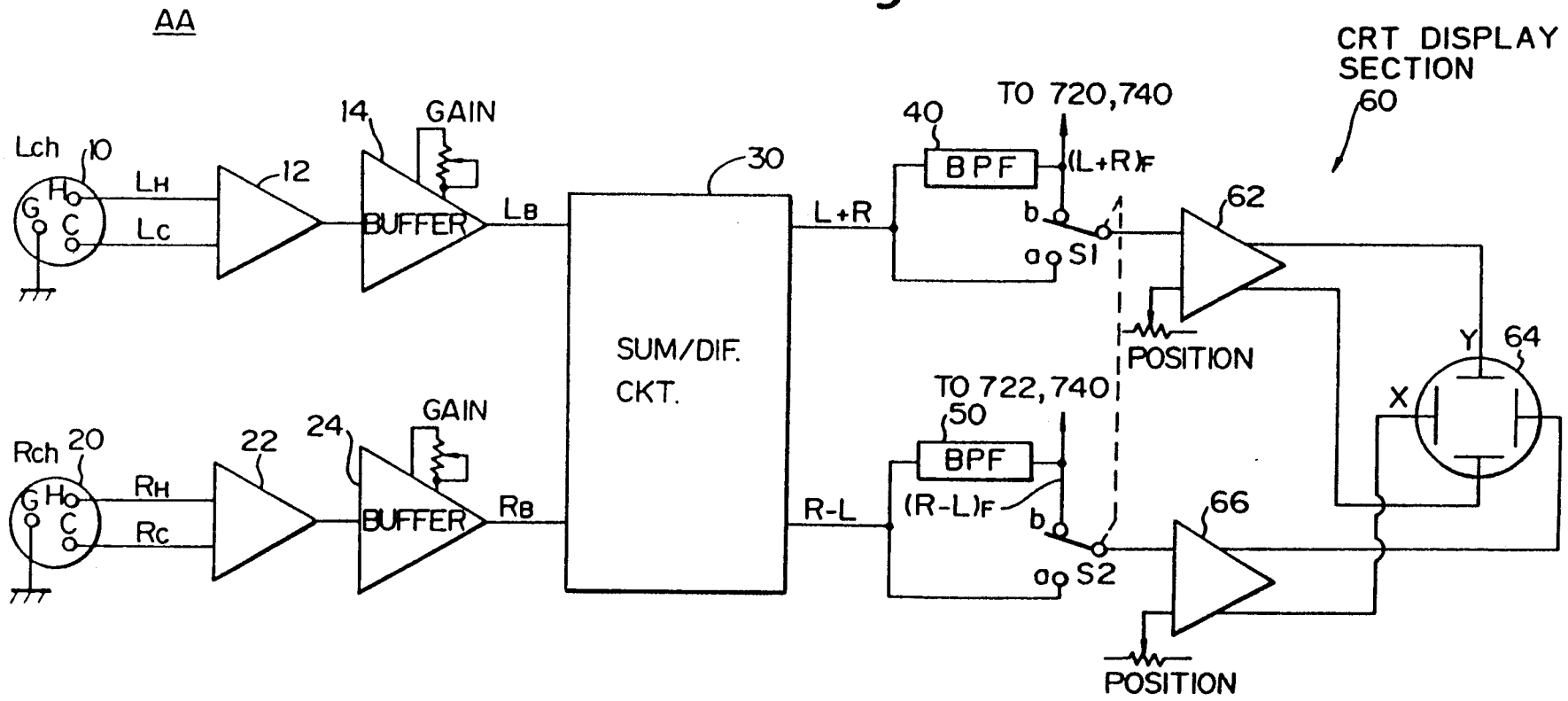
Figure 6:
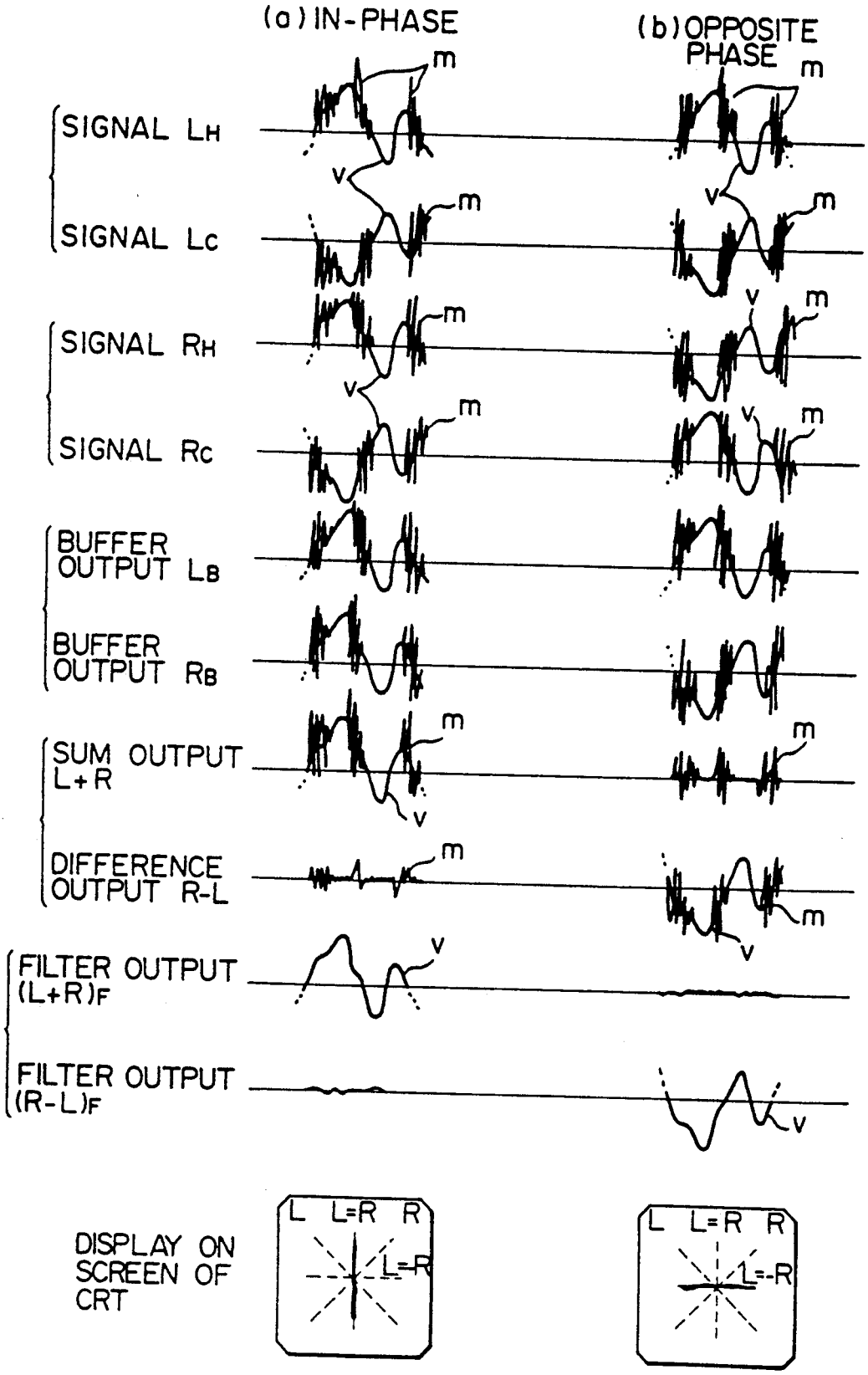
Figure 7A:
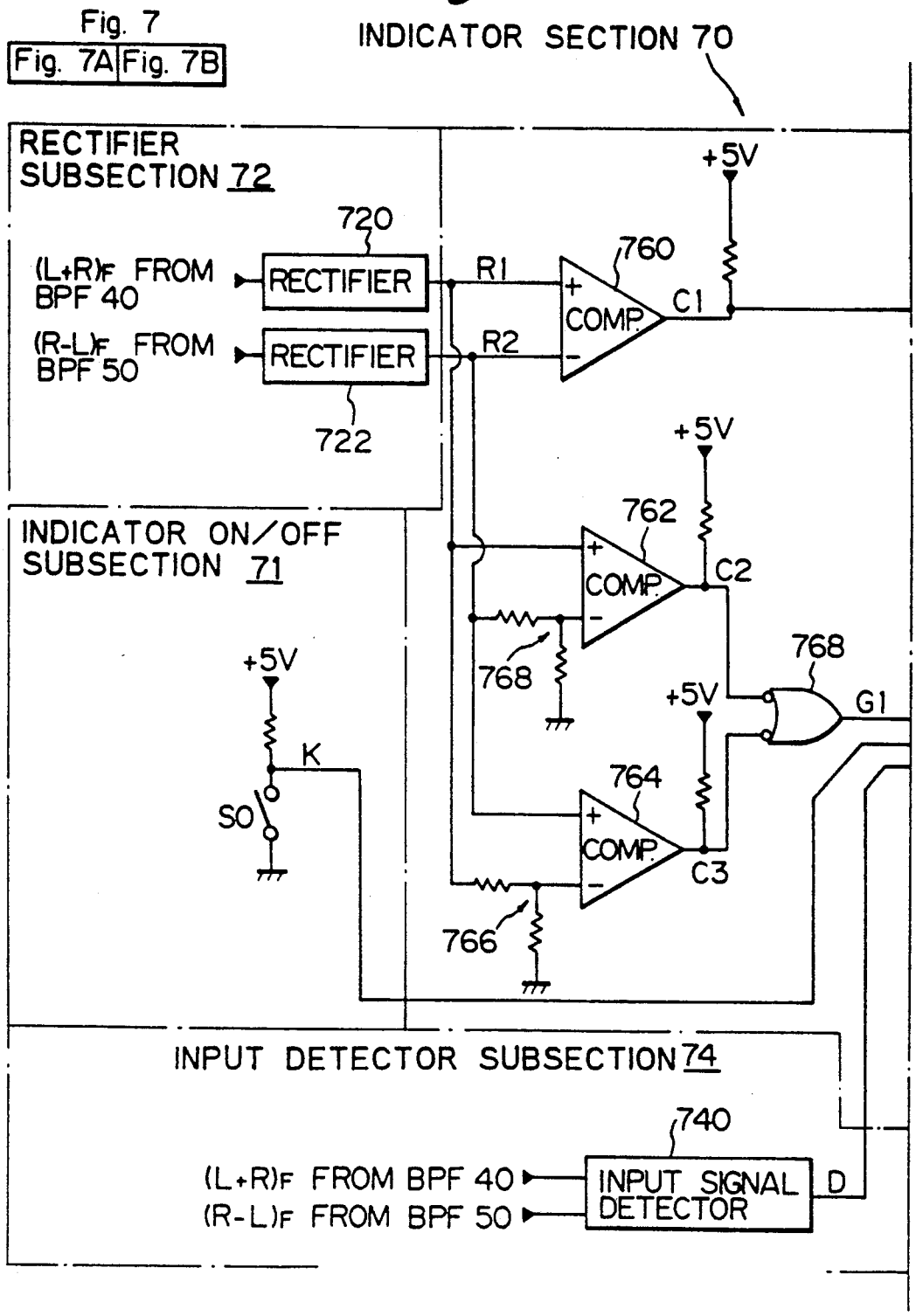
Figure 7B:
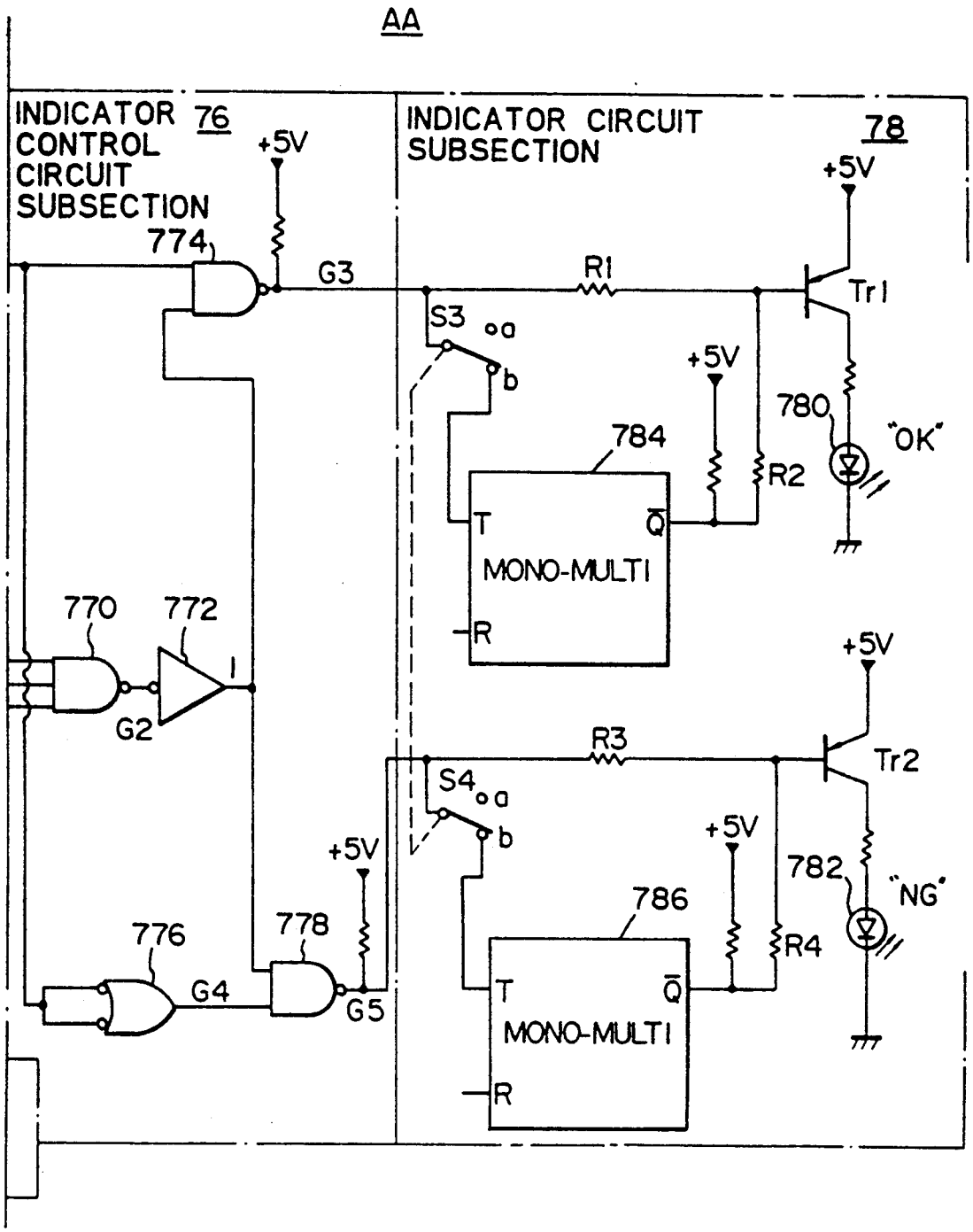
Figures 8, 8A:
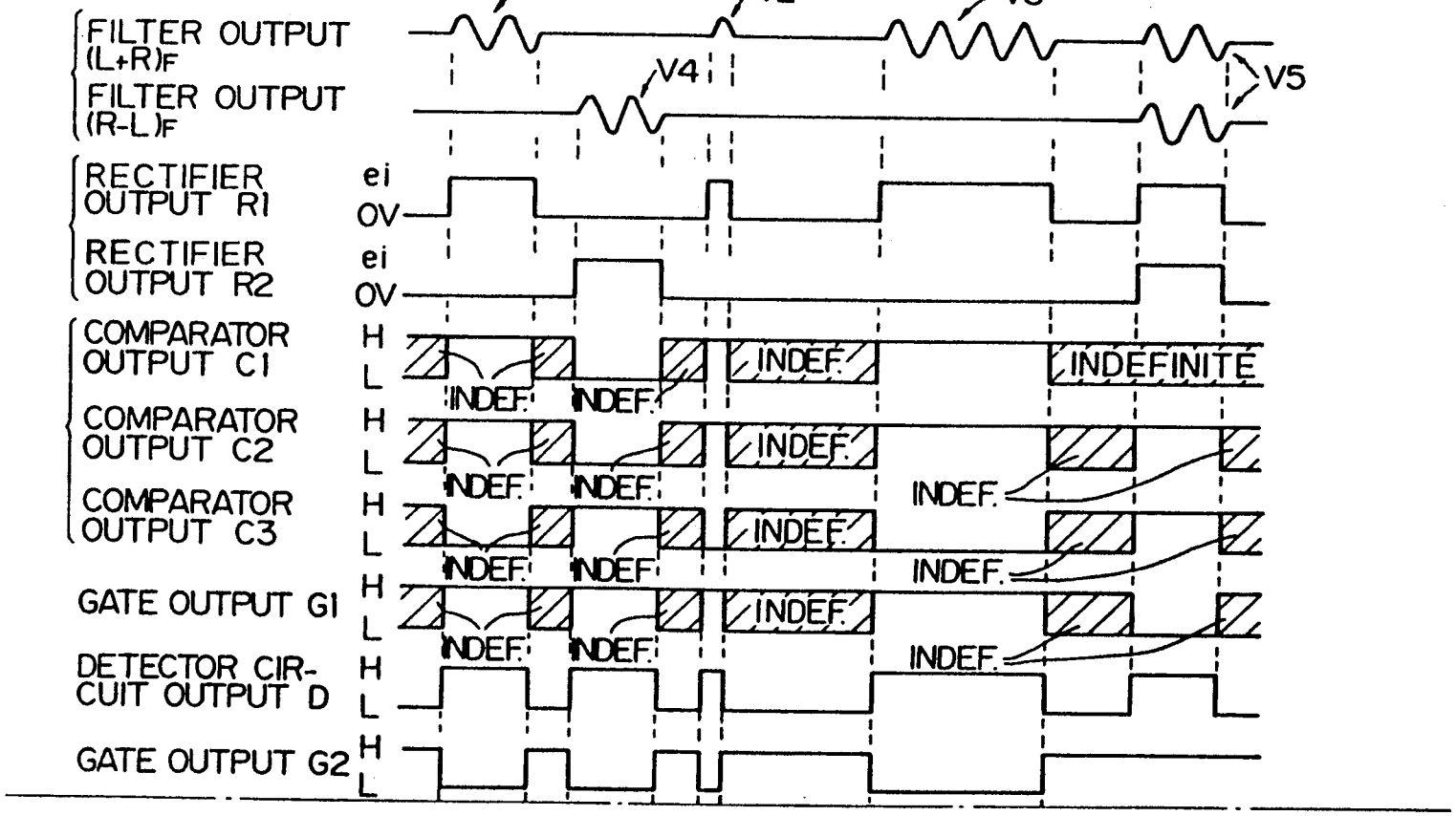
Figure 8B:
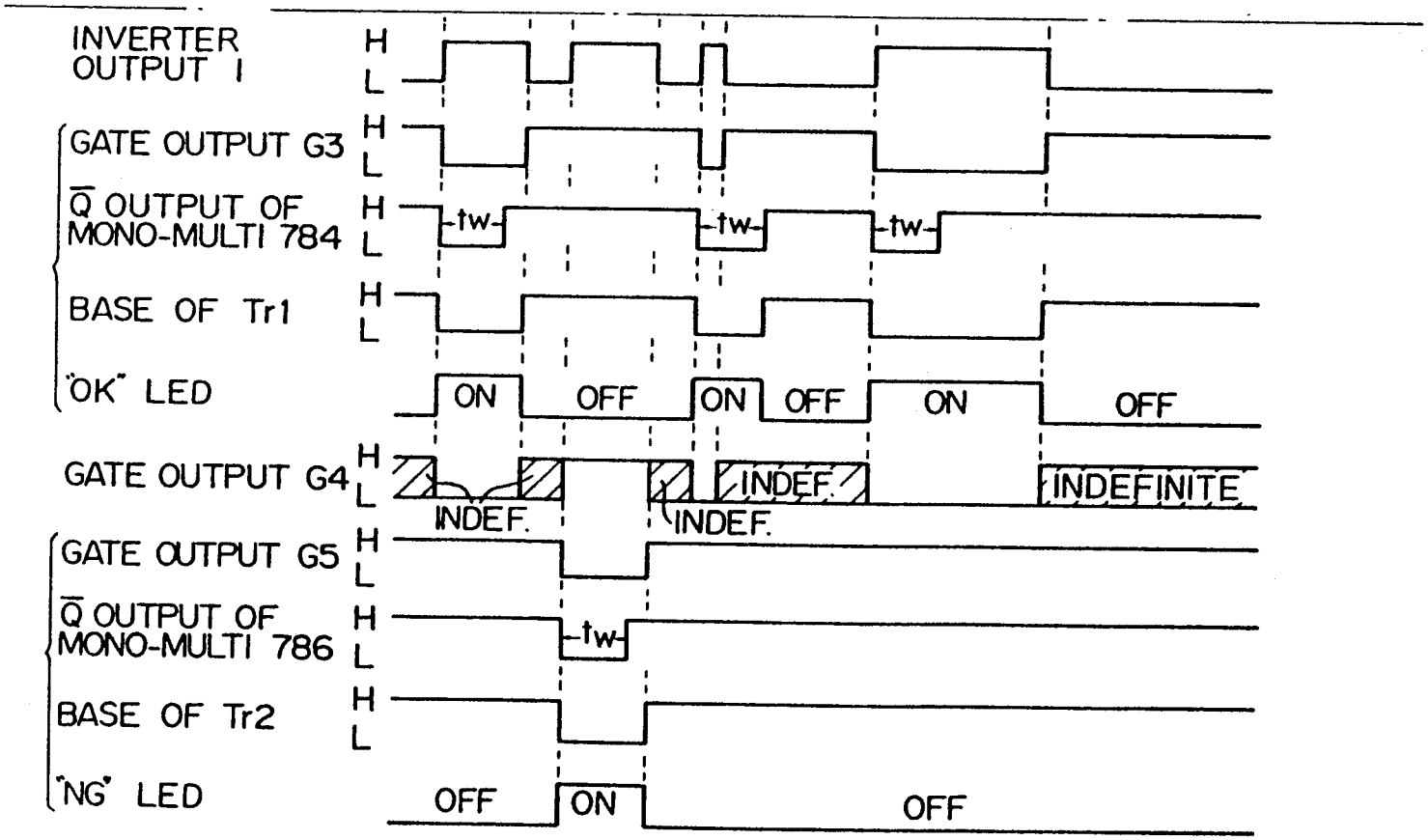
Figure 9:
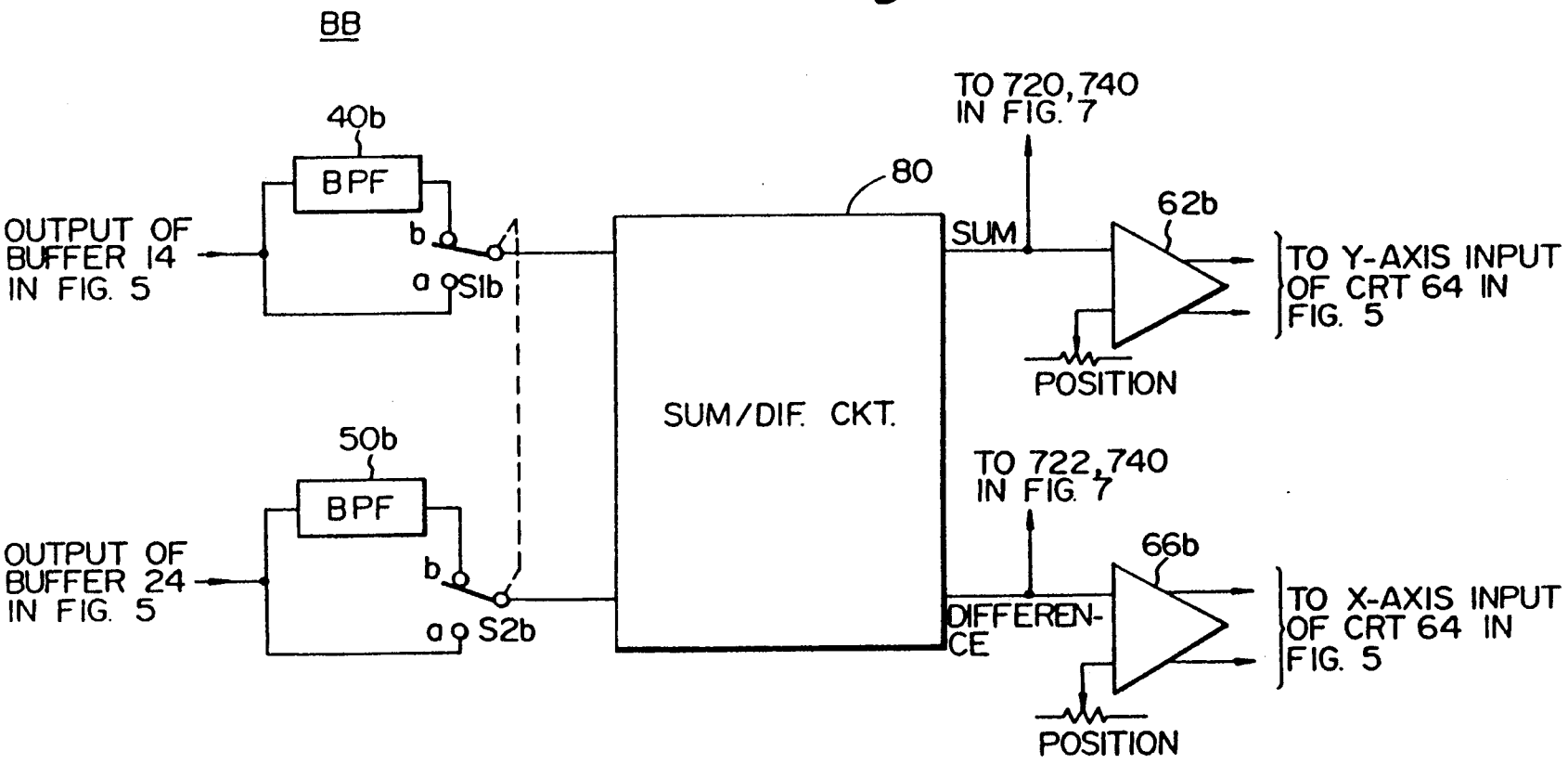
Figure 10:
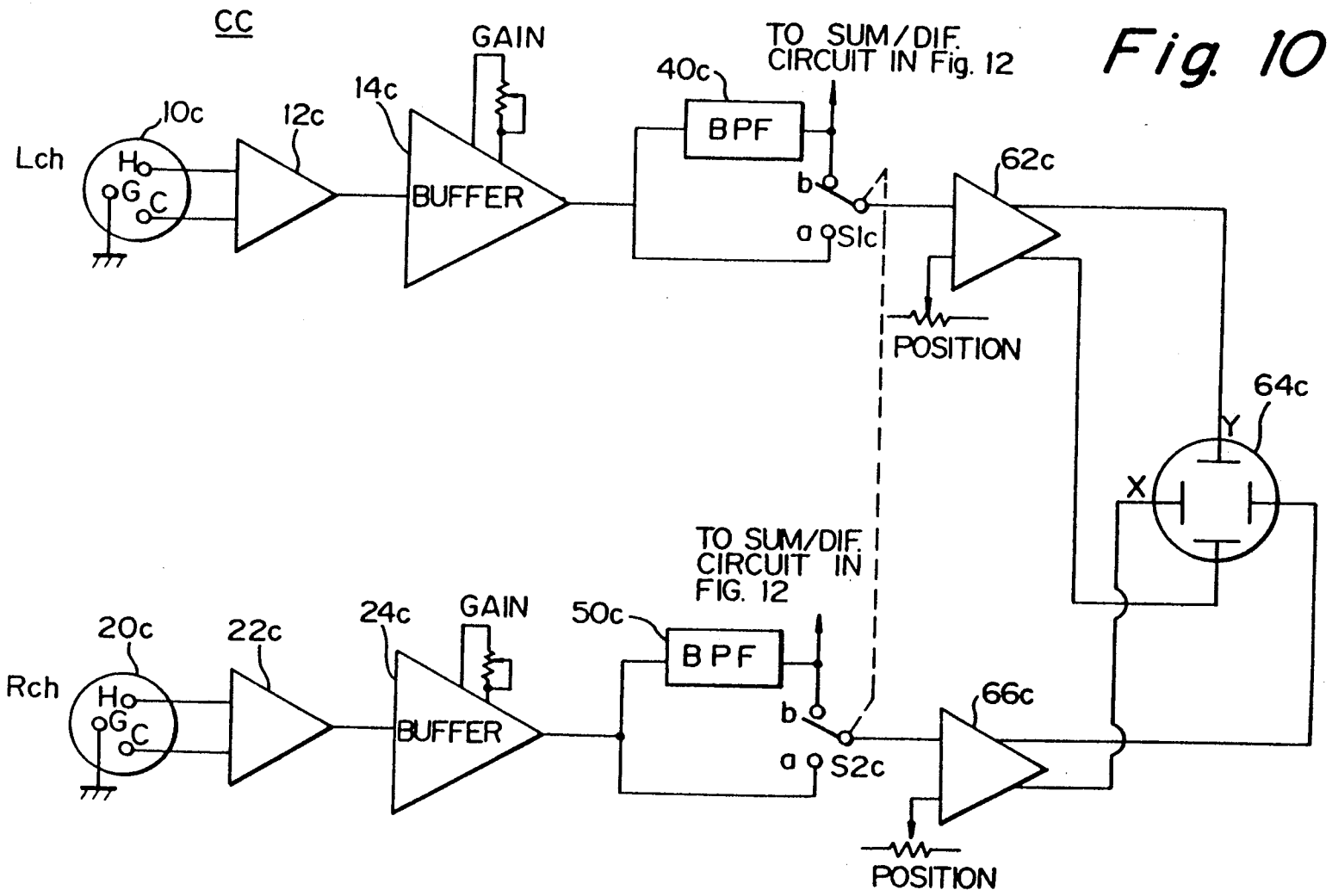
Figure 13A:
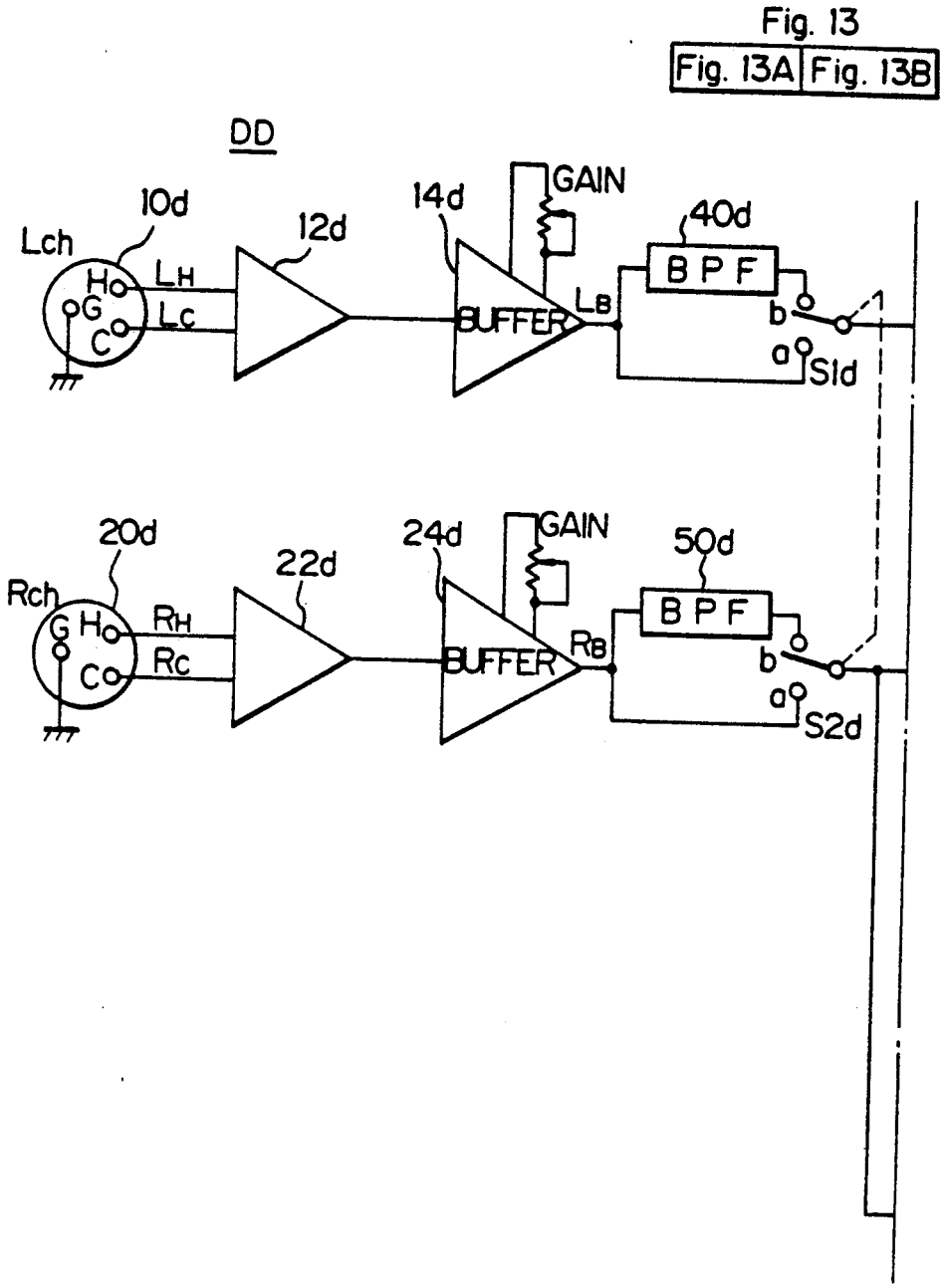
Figure 13B:
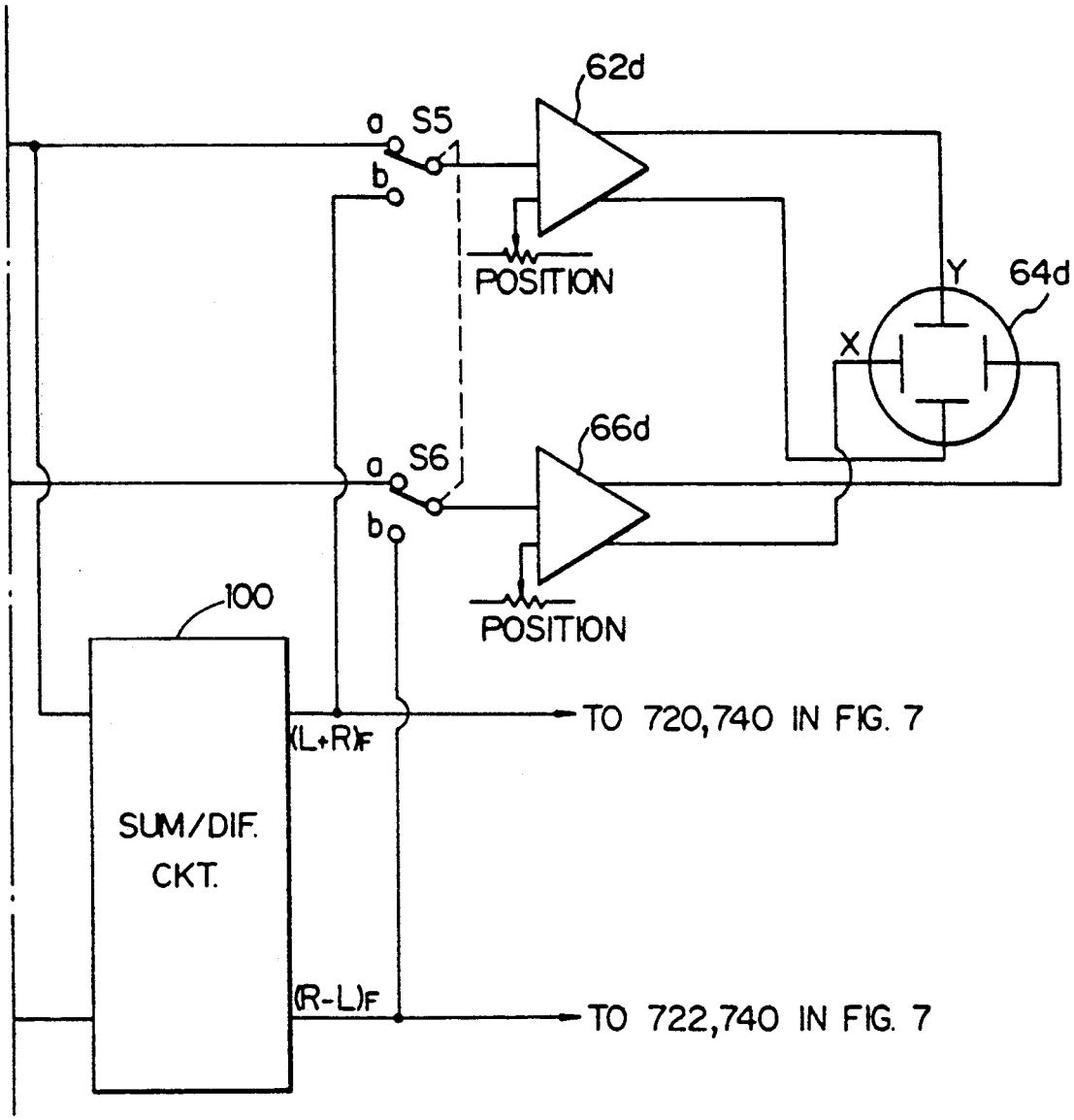

FIGS. *2a-2d* are diagrams showing examples of images displayed on the screen of a CRT provided in the conventional stereo audio scope shown in FIG. 1;

FIG. 3 is a schematic block diagram showing a basic configuration of a determination device according to the present invention;

FIGS. 4A, 4B and 4C are schematic block diagrams showing first, second and third types of determination devices, respectively which comprise several embodiments of the basic configuration shown in FIG. 3;

FIG. 5 is a schematic diagram showing the circuit of a stereo audio monitor AA which has the first-type determination device incorporated therein;

FIG. 6 illustrates waveforms appearing at several locations in the circuit of the monitor AA shown in FIG. 5 and displays on the screen thereof;

FIG. 7 is a schematic diagram illustrating the circuit of the remaining portion of the monitor AA shown in FIG. 5, i.e. an indicator section;

FIG. 8 illustrates waveforms appearing at several locations in the circuit of FIG. 7 and illumination conditions of indicators included therein;

FIG. 9 is a schematic diagram showing a stereo audio monitor BB having the second-type determination device incorporated therein, wherein only a portion of the circuit of the monitor BB is shown which is substituted for a portion of the monitor AA circuit of FIG. 5 for the implementation of the monitor BB;

FIG. 10 is a schematic diagram showing the circuit of a stereo audio monitor CC which has the third-type determination device incorporated therein;

FIG. 11 illustrates examples of the image displayed on the screen of a CRT included in the monitor CC;

FIG. 12 is a block diagram showing the circuit of the remaining portion of the monitor CC, i.e. an indicator section; and FIG. 13 is a schematic circuit diagram showing a portion of the circuit of a stereo audio monitor DD having the second-type and third-type determination devices incorporated therein.

DESCRIPTION OF THE PREFERRED EMBODIMENTS

FIG. 3 shows the basic configuration of a determination device according to the present invention. As will be seen, for the purpose of determining the phase correlation of left channel and right channel signals constituting a stereophonic audio signal, the device includes first and second input terminals to which L-ch and R-ch signals of a stereophonic audio signal are applied respectively. The device also includes first and second extracting means, the inputs of which are coupled to the first and second input terminals, respectively. Each of the two extracting means is operative to extract the centrally localized components of the respective applied signal which are within a selected range of frequencies. The extracted components of each of the two means are applied as an output to an indication means for the indication of the phase correlation between the L-ch and R-ch signals.

Now, referring to FIGS. 4A, 4B and 4C, there are shown in block diagram different determination devices A, B and C which embody the basic configuration of FIG. 3.

Figure 2A:
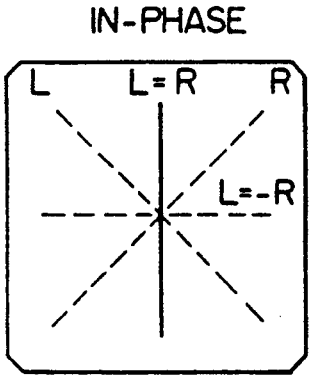
Figure 2B:
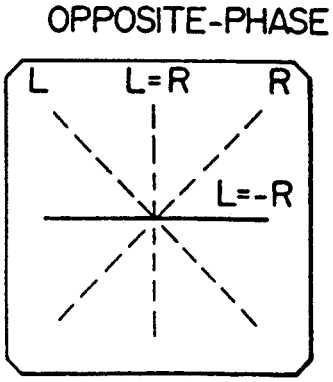
Figure 2C:
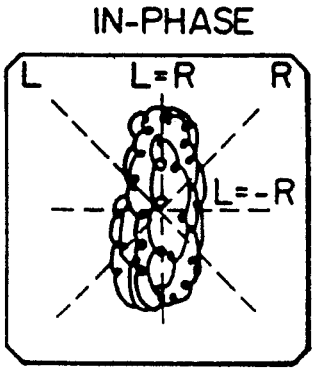
Figure 2D:
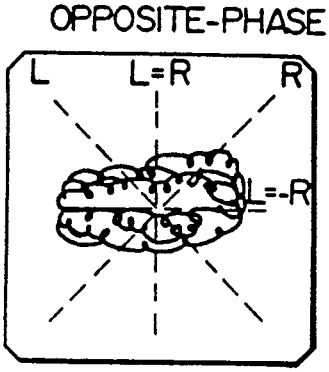

Specifically, a first-type determination device A comprises input terminals 1A and 2A for receiving an L-ch signal and an R-ch signal, respectively, a sum and difference circuit 3A connected to receive the L-ch and R-ch signals from the input terminals 1A and 2A for generating a sum output (L+R) and a difference output (R−L), bandpass filters (BPF) 4A and 5A connected to receive the sum and difference outputs, respectively, for passing those of the components of selected frequencies, and one or both of an X-Y display means 6A (such as a CRT display) and an indicator means 7A connected to receive these outputs from the bandpass filters 4A and 5A (FIG. 4A shows that the device includes both of them). Preferably, the pass band of the bandpass filters 4A and 5A is selected to have a range of 600±200 Hz, because a person's voice, has a narrower bandwidth in terms of frequency spectrum than those of other musical instruments and because both the male and female voice contain a lower number of high-pitch sound components of 1 kHz or higher. The range, however, may be widened, narrowed or shifted if necessary (ex. a range of 350±200 Hz). The X-Y display means 6 is adapted to draw a Lissajous' figure in a real time basis by receiving outputs from the BPFs 4A and 5A at a Y-axis input and an X-axis input, respectively, of the display, as in a prior art. The indicator means 7A is adapted to receive the outputs from the BPFs 4A and 5A and to indicate at indicators, in a real time indication mode or a hold indication mode, whether the received L-ch signal and R-ch signal are in phase or in opposite phase. The sum and difference circuit 3A serves to rotate a sound image display on the X-Y display means 6A by 45° in the counter-clockwise direction such that the in-phase state is indicated by a central vertical locus (i.e. L=R) and the opposite phase state by a central horizontal locus (i.e. L=−R) (see FIGS. 2*a* and 2*b*), thereby facilitating the determination of in-phase or opposite-phase.

A second-type determination device B shown in FIG. 4B is identical to the first-type device A except that a sum and difference circuit labelled 8B is disposed at the side of the outputs of BPFs 4B and 5B. It should be noted that elements in FIG. 4B similar to those in FIG. 4A are designated by the same reference numerals each with a suffix "B" added. The function of the device B is therefore identical to that of the device A.

A third-type determination device C is similar to the second-type device B except that only an indicator means 7C receives outputs from BPFs 4C and 5C through a sum and difference circuit labelled 9C. Again, elements in FIG. 4C similar to those in FIG. 4A are designated by the same reference numerals with a letter "C" suffixed to each numeral. In the third-type device C, one or both of an X-Y display means 6C and an indicator means 7C may be provided, as in the devices A and B. Since a X-Y display means 6C provided in the device C receives an L-ch signal from a BPF 4C at an X-axis input and an R-ch signal from a BPF 5C at a Y-axis input without intervention of a sum and difference circuit, a displayed sound image is rotated by 45° in the clockwise direction, compared with those displayed by the devices of FIGS. 4A and 4B.

Next, referring now to FIGS. 5 and 7, it is shown an embodiment of a stereo audio monitor AA incorporating the first-type device A shown in FIG. 4A. The monitor AA is an example which includes both of X-Y display means and indicator means as the indication means mentioned above. Alternatively, it may be modified to include either one of them, as described above.

Referring first to FIG. 5, the monitor AA has connectors 10 and 20 to which an L-ch signal and an R-ch signal of a stereophonic audio signal are applied, respectively. Since the connectors 10 and 20 are of a balanced type, each of the connectors includes a hot (H), a cold (C) and a ground (G) terminals. The H and C terminals of the connectors 10 and 20 (signals from these terminals are represented by $L_H$, $L_C$ and $R_H$, $R_C$) are then connected to balanced-to-unbalanced transformer circuits 12 and 22, respectively, each of which comprises a differential amplifier. Outputs from the respective transformer circuits are connected to gain-controlled buffer amplifiers 14 and 24. The buffers 14 and 24 provide outputs (signals on these outputs are represented by $L_B$ and $R_B$, respectively) which are in turn connected to a sum and difference circuit 30. The circuit 30 is comprised of a summing amplifier and a subtraction amplifier and is adapted to generate a (L+R) output representative of the sum of the signals $L_B$ and $R_B$ and a (R−L) output representative of the difference between the signal $R_B$ and the signal $L_B$. The sum output is connected to the input of a bandpass filter (BPF) 40 as well as to a terminal a of a switch S1, while the difference output is connected to the input of a bandpass filter (BPF) 50 as well as to a terminal a of a switch S2. The switches S1 and S2 are linked together. In the present embodiment, the pass band of the BPFs 40, 50 is selected to have the range of 600±200 Hz such that a person's voice components are effectively extracted. The other terminals b of the respective switches S1 and S2 are connected to the outputs of the BPFs 40 and 50, respectively (signals on the outputs of the BPFs are represented by $(L+R)_F$ and $(R-L)_F$, respectively). These outputs of the BPFs 40 and 50 are also connected to the indicator section 70 shown in FIG. 7, as will be later described.

Then, the outputs of the switches S1 and S2 are connected to a CRT display section 60. More specifically, the output of the switch S1 is connected to the Y-axis input of a CRT display 64 through an unbalanced-to-balanced transformer circuit 62 comprising a differential amplifier, while the output of the switch S2 is likewise connected to the X-axis input of the CRT display 64 through an unbalanced-to-balanced transformer circuit 66 comprising a differential amplifier.

The monitor AA has two modes of operation, i.e. a conventional mode of displaying a normal stereo sound image which is effective when the switches S1 and S2 are turned to side a and a mode for determining phase correlation according to the present invention which is effective when the switches S1 and S2 are set to side b.

Now, the operation of the monitor AA in the phase correlation determination mode will be described with reference to the waveform diagram shown in FIG. 6. The operation of the monitor in the stereo sound image display mode is well known, and thus explanation thereof is omitted.

For the purpose of explanation, it is assumed that an L-ch signal and an R-ch signal shown in FIG. 6 and received by the monitor AA constitute a stereophonic signal for a CM program which contains a centrally localized narration, and that each of the channel signals consists of a respective-channel voice component v for narration and another respective-channel music component m. Then, FIG. 6*a* shows various waveforms appearing at different locations in the circuit shown in FIG. 5 and an image displayed on the screen of the CRT 64 when the L-ch R-ch signals are in phase with each other, while FIG. 6*b* shows those waveforms and images when the signals are in opposite phase.

First, when the L-ch and R-ch signals are in phase as shown in FIG. 6*a*, the signals $L_H$ and $R_H$ and the signals $L_C$ and $R_C$ are respectively in phase as shown in the drawing, and thus the buffer outputs $L_B$ and $R_B$ are also in phase. Then, the sum of the buffer outputs L+R assumes a waveform having the voice component v and the music sound component m superimposed thereon, while the difference output assumes a waveform substantially formed of the music sound component m. Thus, the BPF output $(L+R)_F$ includes substantially only the voice component v, and the other BPF output $(R-L)_F$ includes only the components of the music sound component m the frequencies of which are within the pass band, i.e. 400–800 Hz, and the amount of which is substantially equal to zero. Then, displayed on the screen of the CRT 64 is an approximately linear central vertical line which is indicative of L=R (in phase condition).

On the other hand, in the case of opposite phase as shown in FIG. 6*b*, the signals $L_H$ and $R_H$ are in opposite phase to each other and the same is true of the signals $L_C$ and $R_C$. Then, the buffer outputs $L_B$ and $R_B$ are also in opposite phase. Thus, the sum output L+R substantially only includes the music component m, while the difference output R−L assumes a waveform composed of the voice component v and the music component m. In this even, the BPF output $(L+R)_F$ includes minute components of the music component m within the pass band, while the BPF output $(R-L)_F$ includes substantially only the voice component v. Thus, an approximately linear central horizontally extended locus indicative of L=−R (opposite-phase condition) is displayed on the screen of the CRT 64. As will be understood from the above explanation, the phase condition, that is, inphase or opposite-phase correlation is clearly and distinctively displayed.

Next, the indicator section 70 of the monitor AA will be described with reference to FIGS. 7 and 8. The indicator section 70 is arranged to provide an indication "OK" for an in-phase correlation and an indication "NG" for an opposite-phase correlation. As illustrated, the indicator section comprises an indicator ON/OFF subsection 71, a rectifier subsection 72, an input detector subsection 74, an indicator control circuit subsection 76 and an indicator circuit subsection 78.

The ON/OFF subsection 71 includes a switch SO, the output K of which is set to "high" when the indicator section 70 is to be turned on and to "low" when turned off. The rectifier subsection 72 includes a pair of full-wave rectifiers 720 and 722 which receive outputs from the BPFs 40 and 50, respectively. The rectifiers 720 and 722 have characteristics adapted for a peak meter (the DIN standard) and generate outputs R1 and R2, respectively. The detector subsection 74 comprises an input signal detecting circuit 740 which is connected to receive the outputs from the BPFs 40 and 50 in order to determine whether inputs to the section are present or not. The detecting circuit 740, though not shown, is comprised of a pair of comparators and an OR gate. The comparators compare the respective outputs from the BPFs with a reference, and the resulting outputs of the comparators are ORed by the OR gate to form an output D which is "high" when the inputs are present and "low" when absent. The control circuit subsection 76 includes comparators 760, 762 and 764 which have non-inverting and inverting input terminals connected to the rectifier output R1 and R2. It should be noted that the output R1 is connected to the comparator 764 through an attenuator 766 (comprised of a pair of resistors) which provides a slight attenuation (ex. −6 dB) of an input to the comparator 764. Also, the output R2 is connected to the comparator 762 through a similar attenuator 768 which gives a slight attenuation (ex. −6 dB) to an input for the comparator 762. The comparator 760 functions to determine the magnitude relationship between R1 and R2 and to generate an output C1 which is at high level when R1 is larger than R2 (R1>R2) and at low level when R1 is smaller than R2 (R1<R2). The comparator 762 is arranged to identify whether or not R1 is substantially equal to or larger than R2 and generate an output C2 which is at high level when R1=R2 or R1>>R2 and at low level when R1<<R2. Also, the comparator 764 is adapted to identify whether or not R1 is substantially equal to or smaller than R2 and generate an output C3 which is at high level when R1=R2 or R1<<R2 and at low level when R1>>R2.

A negative logic input OR gate 768 connected to receive the outputs C2 and C3 from the comparators 762 and 764 functions to identify whether or not R1 is approximately equal to R2 and thus generate an output G1 which is at high level when R1>>R2 or R1<<R2 and at low level when R1=R2. A NAND gate 770 which is connected to receive the output G1 as well as the outputs D and K provides an output G2 by passing the output G1 only when the indicator section 70 is on and if inputs to the section are present. The output G2 is inverted by an inverter 772 which generates an output I. Thus, the output I will be high when inputs to the section are present and if R1=R2 is not satisfied, and otherwise will be low.

A NAND gate 774 is connected to receive the comparator output C1 and the inverter output I. The gate 774 is provided to identify whether of not there is an in-phase condition. The output G3 of the NAND gate 774 will be low when there are inputs, R1=R2 is not satisfied, and R1>>R2 stands (i.e. in an in-phase and same-amplitude state), and otherwise will be high. A negative logic input OR gate 776 is connected to receive the comparator output C1 and serves as an inverter. An output G4 from the OR gate 776 as well as the inverter output I is applied to a NAND gate 778 which generates an output G5 which is at low level when there are inputs, R1=R2 is not satisfied, and R1<<R2 stands (i.e. in an opposite-phase and same-amplitude state), and otherwise the output G5 will be at a high level.

Then, the indicator circuit subsection 78 includes two identical circuits in order to drive a green LED indicator 780 for an indication "OK" (i.e. for the indication of in-phase state) and a red LED indicator 782 for an indication "NG" (i.e. for the indication of opposite-phase state). More specifically, in connection with the OK indicator 780, there are provided a switching transistor Tr1 having a collector connected to the indicator through a resistor, a resistor R1 for coupling the gate output G3 to the base of the transistor Tr1, a switch S3 connected to receive the output G3 for selecting a real time indication mode (side a) or a hold indication mode (side b), a mono-multivibrator 784 having a trigger (T) terminal connected to a switch contact at the side b, and a resistor R2 for coupling the Q* (a symbol "*" indicates inversion) output of the mono-multi 784 to the base of the transistor Tr1. The width tw of pulses generated from the mono-multi 784 is selected to be five seconds in the present embodiment. Similarly, in connection with the NG indicator 782, provided are a switching transistor Tr2, a resistor R3, a switch S4 linked to the switch S3, a mono-multi 786, and a resistor R4.

Now, the operation of the whole indicator section 70 will be described with reference to FIG. 8.

First, the hold indication mode, selected by the switches S3 and S4 turned to the respective side b, will be explained. It should be noted that the BPF outputs $(L+R)_F$ and $(R-L)_F$ as shown in FIG. 8 are different from those shown in FIG. 6 for the purpose of explanation. Specifically, the filter output $(L+R)_F$ includes a voice component v1 slightly longer than the pulse width tw, a voice component v2 shorter than tw, and a voice component v3 lasting much longer than tw, all of which occur with the in-phase correlation, while the filter output $(R-L)_F$ includes a voice component v4 slightly longer than tw upon the opposite-phase correlation. Also, the both outputs include a voice component v5 at the time when there is a single channel input (R-ch signal in this embodiment).

In connection with the voice component v1 upon the in-phase condition, since the gate output G3 remains low for a time period longer than the Q* output of the mono-multi 784, the output G3 keeps biasing the transistor Tr1 to be on even if the Q* returns to high within the time period in which the gate output G3 is low, thereby illuminating the "OK" LED indicative of in-phase during that time period. Next, with the shorter voice component v2, the Q* output from the mono-multi 784 remains low during the time period of the pulse width tw to keep biasing the transistor Tr1 to be on even after the gate output G3 returns to high, thereby illuminating the "OK" LED as long as the Q* output is low. The operation is advantageous in facilitating the determination of an in-phase or opposite-phase state from short voice components. For the longer continuous voice component v3, the indicator section 70 operates in a similar manner to that for the first voice component v1.

On the other hand, in connection with the voice component v4 occurring in the opposite-phase correlation, since the gate output G5 remains low for a time period longer than the pulse width tw during which the Q* output from the mono-multi 786 is low, the gate output G5 keeps biasing the transistor Tr2 to be on during the duration of the voice component v4 even after the Q* output returns to high, thereby continuing to illuminate the "NG" LED during that duration.

Finally, as to the voice component v5, since it is a single channel signal, the determination of in-phase or opposite-phase state cannot be performed. Thus, the inverter output I will not switch to low and accordingly neither of the gate outputs G3 and G5 will become low, resulting in no illumination of the "OK" and "NG" LEDs.

When the real time indication mode is selected by turning the switches S3 and S4 of the indicator circuit subsection 78 to the side a, the "OK" LED will be illuminated as long as the gate output G3 remains low, while the "NG" LED will be illuminated during the time period when the gate output G5 remains low.

As described above, the indicator section 70 can be operated in either a real time indication mode similar to a real time display on a CRT or in the hold indication mode.

It will be noted that the circuit shown in FIG. 7 allows the "OK" and "NG" LEDs 780 and 782 to be simultaneously illuminated. For eliminating such an illuminated state, the gate output G5 may be applied to the reset (R) terminal of the mono-multi 784, and the gate output G3 to the reset (R) terminal of the other mono-multi 786.

Referring now to FIG. 9, a stereo audio monitor BB has the second-type determination device shown in FIG. 4B incorporated therein, the circuit of which is substantially similar to that of the monitor AA shown in FIGS. 5 and 7 (elements of the monitor BB similar to those of FIG. 5 are designated by the same reference numeral with a suffix "b"). As seen from FIG. 9, the monitor BB can be implemented by modifying the circuit of FIG. 5 in such a manner that a sum and difference circuit 80 is disposed at the side of the outputs of switches S1*b* and S2*b* with the sum and difference circuit 30 of FIG. 5 removed, that the two outputs of the sum and difference circuit 80 are connected to transformer circuits 62*b* and 66*b*, respectively, as well as to the full wave rectifiers 720 and 722, respectively, of the indicator section 70 and the input signal detecting circuit 740 in place of the BPF outputs.

Now, referring to FIGS. 10 and 12, the circuit diagram of a stereo audio monitor CC is shown in which the third-type determination device shown in FIG. 4C is incorporated. As can be seen from the drawings, the circuit shown in FIGS. 10 and 12 is substantially similar to that of FIGS. 5 and 7 (again, elements in FIGS. 10 and 12 similar to those in FIGS. 5 and 7 are designated by the same reference numerals with a suffix "c"). The monitor CC differs from the monitor AA only in that the former does not include a sum and difference circuit corresponding to the sum and difference circuit 30, and that the outputs of BPFs 40*c* and 50*c* are supplied to an indicator section 70*c* through a sum and difference circuit 90. Thus, the indicator section 70*c*, however, will receive inputs equivalent to those supplied to the indicator section 70 (i.e. $(L+R)_F$ and $(R-L)_F$).

The difference in operation between the monitor CC and the monitor AA only lies in the arrangement of images which are displayed on the screen of the CRT 64. As seen from FIG. 11, when L-ch and R-ch signals are in phase, a central locus rising toward the right is displayed on the screen of the CRT 64*c* as shown in FIG. 11*a*, and when they are in opposite phase, a locus falling toward the right is displayed as shown in FIG. 11*b*.

Finally, referring to FIG. 13, a stereo audio monitor DD having both the second-type and third-type devices B and C incorporated therein is shown. Again, elements of the monitor DD similar to those of FIG. 5 are designated by the same reference numeral with a suffix "d". The monitor DD differs from the monitor BB shown in FIG. 9 in that the former is provided with switches S5 and S6. Contacts a of the respective switches S5 and S6 are connected to the outputs of corresponding switches S1*d* and S2*d*, respectively, while contacts b of the switches S5 and S8 are connected respectively to the outputs of a sum and difference circuit 100 which corresponds to the sum and difference circuit 80 shown in FIG. 9 or the sum and difference circuit 90 shown in FIG. 12. Also, the outputs of the switches S5 and S6 are connected to corresponding transformer circuits 62*d* and 66*d*, respectively. Therefore, the monitor DD performs the same function as the monitor CC when the switches S5 and S6 are turned to the respective side a and the same function as the monitor BB with the switches S5 and S6 turned to the side b.

According to the determination apparatus and method of the present invention as described above in detail, since signal components required for the determination of phase correlation of a stereophonic audio signal, particularly in-phase or opposite-phase state, are extracted from a stereophonic audio program or stereophonic audio signal under examination and thereafter display or indication for facilitating the determination of phase correlation is provided, resulting in a more precise and more rapid determination of phase correlations.

Further, by providing such a hold indication mode as described above for an indicator section, examination of only a short portion of each stereophonic audio program under test will be sufficient to provide an indication necessary for the determination of phase correlation. Thus, when it is desired to make the phase determination for a short time in editing commercial tapes, for example, in a broadcasting station, such determination can be carried out promptly by examining an initial two or three second portion of the respective commercial tape.

What is claimed is:

1. A method for determining a phase correlation existing between a left-channel signal and a right-channel signal constituting a stereophonic audio signal, comprising the steps of:

a) receiving a left-channel signal and a right-channel signal from a given stereophonic audio program including centrally localized components having frequencies within a predetermined frequency band and generating a first signal and a second signal from said left-channel and right-channel signals;

b) extracting from said first and second signals components having frequencies within a selected range of frequencies in said predetermined frequency band to provide a third signal and a fourth signal, respectively; and c) generating a fifth signal and a sixth signal from said third and fourth signals for providing an indication representative of a phase correlation existing between said left-channel and right-channel signals of said given stereophonic audio program on the basis of said fifth and sixth signals, said generating comprising the steps of:

illuminating a first indicator indicative of an in-phase state when a rectified value of said fifth signal is larger than a rectified value of said sixth signal, and illuminating a second indicator indicative of an opposite-phase state when the rectified value of said fifth signal is smaller than the rectified value of said sixth signal, and holding each of said first and second indicators, once illuminated, in an illuminated condition for at least a predetermined time period unless the magnitude relationship between the rectified values of said fifth and sixth signals determined in the illuminating step becomes inverted.

2. A determination method according to claim 1, wherein:

said given program is a commercial program; and said centrally localized components are comprised of a person's voice providing narration in said commercial program.

3. A determination method according to claim 2, wherein said selected range of frequencies ranges from 150 to 550 Hz.

4. A determination method according to claim 1, wherein said step b) includes the step of passing said first and second signals through bandpass filters respectively having a pass band equal to said selected range of frequencies.

5. A determination method according to claim 1, wherein:

said step a) includes the step of summing said left-channel and right-channel signals to generate said first signal and subtracting said left-channel signal from said right-channel signal to generate said second signal; and said step c) includes the step of using said third signal as said fifth signal and said fourth signal as said sixth signal.

6. A determination method according to claim 1, wherein:

said step a) includes the step of using said left-channel signal as said first signal and said right-channel signal as said second signal; and said step c) includes the step of summing said third and fourth signals to generate said fifth signal and substracting said fourth signal from said third signal to generate said sixth signal.

7. A determination method according to claim 1, wherein said step c) includes the step of providing an X-Y display for said fifth and sixth signals.

8. An apparatus for determining a phase correlation between a left-channel signal and a right-channel signal constituting a stereophonic audio signal, comprising:

a) a first input terminal for receiving a left-channel signal of a given stereophonic audio signal and a second input terminal for receiving a right-channel signal of said given stereophonic audio signal;

b) sum and difference circuit means coupled to receive said left-channel signal from said first input terminal and said right-channel signal from said second input terminal for generating a sum of said left-channel and right-channel signals as a first signal and for generating a difference derived by subtracting said left-channel signal from said right-channel signal, as a second signal;

c) first extracting means for extracting from said first signal components having frequencies within a selected range of frequencies to generate a third signal, said selected range of frequencies extending to include at least a portion of centrally localized components included in said given stereophonic audio signal;

d) second extracting means for extracting from said second signal components having frequencies within said selected range of frequencies to generate a fourth signal; and e) indication means coupled to receive said third and fourth signals for providing an indication representative of a phase correlation existing between said left-channel and right-channel signals of said given stereophonic audio signal on the basis of said third and fourth signals, wherein said indication means includes indicator means responsive to said third and fourth signals, said indicator means comprising:

i) a first indicator adapted to be illuminated to indicate an in-phase state;

ii) a second indicator adapted to be illuminated to indicate an opposite-phase state;

iii) first rectifier means for rectifying said third signal to generate a first rectified signal;

iv) second rectifier means for rectifying said fourth signal to generate a second rectified signal;

v) control means for enabling said first indicator to be illuminated when said first rectified signal is larger than said second rectified signal, for enabling said second indicator to be illuminated when said first rectified signal is smaller than said second rectified signal, and for enabling neither of said first and second indicators to be illuminated when said first and second rectified signals are substantially equal in magnitude to each other; and vi) hold means for holding each of said first and second indicators, once illuminated, in an illuminated condition for at least a predetermined time period, said hold means including means for disabling the holding of said each indicator in the illuminated condition even before the expiration of said predetermined time period associated with said each indicator when the other indicator is to be illuminated.

9. A determination apparatus according to claim 8, wherein:

said given stereophonic audio signal is fed from a commericial program; and said centrally localized components are comprised of a person's voice providing narration in said commercial program.

10. A determination apparatus according to claim 9, wherein said selected range of frequencies extends from 150 to 500 Hz.

11. A determination apparatus according to claim 8, wherein each of said first and second extracting means comprises a bandpass filter having a pass band equal to said selected range of frequencies.

12. A determination apparatus according to claim 8, wherein said indication means includes a CRT display having said third and fourth signals supplied to a Y-axis input and an X-axis input, respectively, thereof.

13. An apparatus for determining a phase correlation between a left-channel signal and a right-channel signal constituting a stereophonic audio signal comprising:

a) a first input terminal for receiving a left-channel signal of a given stereophonic audio signal and a second input terminal for receiving a right-channel signal of said given stereophonic audio signal;

b) first extracting means coupled to receive said left-channel signal from said first input terminal for extracting from said left-channel signal components having frequencies within a selected range of frequencies to generate a first signal, said selected range of frequencies extending to include at least a portion of centrally localized components possibly included in said given stereophonic audio signal;

c) second extracting means coupled to receive said right-channel signal from said second input terminal for extracting from said right-channel signal components having frequencies within said selected range of frequencies to generate a second signal; and d) indication means coupled to receive said first and second signals for providing an indication representative of a phase correlation existing between said left-channel and right-channel channel signals of said given stereophonic audio signal on the basis of said first and second signals, said indication means including sum and difference circuit means for providing a sum of said first and second signals as a third signal and a difference derived by subtracting said first signal from said second signal as a fourth signal, and indicator means responsive to said third and fourth signals, said indicator means including:

i) a first indicator adapted to be illuminated to indicate an in-phase state;

ii) a second indicator adapted to be illuminated to indicate an opposite-phase state;

iii) first rectifier means for rectifying said third signal to generate a first rectified signal;

iv) second rectifier means for rectifying said fourth signal to generate a second rectified signal;

v) control means for enabling said first indicator to be illuminated when said first rectified signal is larger than said second rectified signal, for enabling said second indicator to be illuminated when said first rectified signal is smaller than said second rectified signal, and for preventing both of said first and second indicators from being illuminated when said first and second rectified signals are substantially equal in magnitude to each other; and vi) hold means for holding each of said first and second indicators, once illuminated, in an illuminated condition for at least a predetermined time period, said hold means including means for disabling the holding of said each indicator in the illuminated condition even before the expiration of said predetermined time period associated with said each indicator when the other indicator is to be illuminated.

14. An apparatus according to claim 13, wherein:

said given stereophonic audio signal is fed from a commercial program; and said centrally localized components are comprised of a person's voice providing narration in said commercial program.

15. An apparatus according to claim 14, wherein said selected range of frequencies extends from 150 to 550 Hz.

16. An apparatus according to claim 13, wherein each of said first and second extracting means comprises a bandpass filter having a pass band equal to said selected range of frequencies.

17. An apparatus according to claim 13, wherein said indication means includes a CRT display having said third and fourth signals supplied to a Y-axis input and an X-axis input, respectively.

* * * * *